US007878185B2

(12) United States Patent
Shim et al.

(10) Patent No.: US 7,878,185 B2
(45) Date of Patent: Feb. 1, 2011

(54) COOKING APPARATUS WITH PLASMA CLEANING

(75) Inventors: Chan Bo Shim, Seoul (KR); Young Woo Lee, Seoul (KR); Yang Kyeong Kim, Seoul (KR); Yong Seog Jeon, Seoul (KR); Dae Kyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/342,157

(22) Filed: Dec. 23, 2008

(65) Prior Publication Data

US 2009/0229640 A1 Sep. 17, 2009

(30) Foreign Application Priority Data

Mar. 17, 2008 (KR) ..... 10-2008-0024184

(51) Int. Cl.
*F24C 15/00* (2006.01)

(52) U.S. Cl. ..... 126/19 R; 126/21 R; 126/21 A; 126/273 R; 219/121.36; 219/757; 422/5; 422/30; 134/104.1

(58) Field of Classification Search ..... 126/19 R, 126/21 R, 21 A, 273 R; 219/121.36, 757, 219/121.43; 422/5, 906, 30; 134/104.1
See application file for complete search history.

(56) References Cited

U.S. PATENT DOCUMENTS

| | | | | |
|---|---|---|---|---|
| 5,137,697 | A * | 8/1992 | Lathan et al. | 422/186.15 |
| 6,472,647 | B2 * | 10/2002 | Lee et al. | 219/681 |
| 6,528,022 | B1 * | 3/2003 | Kinoshita | 422/186.04 |
| 7,504,066 | B2 * | 3/2009 | Perlov et al. | 422/23 |
| 2006/0237425 | A1 | 10/2006 | Kim et al. | |
| 2007/0119845 | A1 | 5/2007 | Song et al. | |
| 2008/0099475 | A1 | 5/2008 | Lee et al. | |

FOREIGN PATENT DOCUMENTS

| | | | |
|---|---|---|---|
| JP | 2007-295909 | | 11/2007 |
| KR | 10-1995-0003730 | | 2/1995 |
| KR | 10-2003-0071677 | | 9/2003 |
| KR | 10-0712270 | | 4/2007 |
| KR | 712269 | * | 4/2007 |
| KR | 712269 B1 | * | 4/2007 |

* cited by examiner

*Primary Examiner*—Steven B McAllister
*Assistant Examiner*—Avinash Savani
(74) *Attorney, Agent, or Firm*—McKenna Long & Aldridge LLP

(57) ABSTRACT

A cooking apparatus includes a case in which a cooking chamber for cooking food is provided, a heating source provided in the case, a fan configured to circulate air in the cooking chamber; and a plasma discharger provided in the case and configured to generate plasma in order to remove residue from a surface of the case.

7 Claims, 5 Drawing Sheets

COOKING APPARATUS WITH PLASMA CLEANING

CROSS REFERENCE RELATED APPLICATIONS

The present application claims priority under 35 U.S.C. 119 and 35 U.S.C. 365 to Korean Patent Application No. 10-2008-0024184 (filed on Mar. 17, 2008), which is hereby incorporated by reference in its entirety.

THE BACKGROUND

1. The Field

This present invention relates to a cooking apparatus, and more particularly to a cooking apparatus which can remove residue from a cooking chamber.

2. Description of the Related Art

A conventional cooking apparatus is an appliance that cooks food placed in a cooking chamber by using electric power or gas. This kind of cooking apparatus has a problem in that the cooking chamber is contaminated when residues such as oil stains formed during cooking are adhered to a wall surface of the cooking chamber or unpleasant smell is given off by these residues.

In the prior art, in order to remove the residues produced while cooking as described in the above, an inside of the cooking chamber is heated to high temperatures or the residues are chemically decomposed by using detergent. However, in the case that the residues are removed by heating the inside of the cooking chamber to high temperatures, the electric power consumption for this purpose is increased, and the cooking apparatus cannot be used until the cooking chamber is heated to high temperatures. Further, in the case that the residues are removed by using detergent, a coating layer of the wall surface of the cooking chamber may be damaged by the detergent.

THE SUMMARY

The present invention solves the above-noted problems of the prior art. An object of the present invention is to provide a cooking apparatus which can remove residues, formed during cooking food, in an effective and easy manner.

According to an aspect of the present invention, a cooking apparatus includes a case in which a cooking chamber for cooking food is provided; a heating source provided in the case; a fan configured to circulate air in the cooking chamber; and a plasma discharger provided in the case and configured to generate plasma in order to remove residue from a surface of the case.

The plasma discharger may be configured as a module and installed at a wall surface of the case. The plasma discharger may include a casing and a plasma discharge element provided in the casing. The plasma discharge element may include a first electrode which is applied with a voltage, a second electrode which is grounded, and a dielectric disposed between the first and second electrodes. The casing may include a casing body which contains the plasma discharge element and is installed at a wall surface of the case; and a casing cover which covers an opened surface of the casing body, and includes a plurality of through holes.

The plasma discharger may include two plasma dischargers which are installed at two respective sides of the case. The two plasma dischargers may be mounted to the two respective sides of the case at different levels.

A seat groove configured to seat the plasma discharger may be formed in the case. A surface of the plasma discharger facing the cooking chamber may be level with an inner surface of the case. The plasma discharger may be detachably installed in the case. The plasma generated by the plasma discharger may be at least one of ozone ($O_3$), a hydrated ion and a $CH_3$—S radical group.

According to an aspect of the present invention, a cooking apparatus includes a case; a convection device provided in the case and configured to heat and circulate air; and a plasma discharger provided at an inner surface of the case, the plasma discharger including a first electrode which is applied with a voltage, a second electrode which is grounded, and a dielectric provided between the first and second electrodes, the second electrode including the case.

The first electrode may include a wire arranged to have plural bends. The dielectric may include an enamel coating layer provided on an inner surface of the case. The cooking apparatus may further include an insulation layer surrounding the first electrode. The insulation layer may be a coating layer of $SiO_2$ material. The first electrode may be connected to an external power line passing through a side surface of the case. The convection device may include a heater that generates heat and a fan that circulates air inside of the case.

According to an aspect of the present invention, a cooking apparatus includes a case in which a space for cooking food is provided; a door configured to selectively open or close the space for cooking; a plasma discharger provided in the case and configured to generate plasma; a sensor configured to detect the concentration of ozone produced during plasma discharge generation by the plasma discharger; and a locking device configured to restrict opening of the door according to the ozone concentration detected by the sensor.

The cooking apparatus may further include a controller configured to control the operation of the locking device in accordance with the ozone concentration detected by the sensor. When the ozone concentration detected by the sensor is greater than a predetermined value, the door may be prevented from opening by the operation of the locking device. The plasma discharger may be configured as a module and may be installed at an inner side surface of the case.

The plasma discharger may include a first electrode which is installed at an inner side surface of the case and is applied with a voltage, a second electrode which is grounded, and a dielectric disposed between the first and second electrodes. The second electrode may include the case. The plasma discharger may include two plasma dischargers which are respectively mounted to opposed side surfaces in the case. The plasma dischargers may be respectively mounted at different levels.

The cooking apparatus according to the embodiments of the present invention may achieve the following benefits.

First, the residues formed while cooking food are effectively decomposed by the plasma discharged from the plasma discharger. Accordingly, the cooking apparatus always maintains the clean state by simply removing the decomposed residues.

Second, a case and an electrode provided in the case substantially function as first and second electrodes for discharging plasma, without providing an additional electrode or separate plasma discharger, and an enamel coating layer performs a function of a dielectric. Accordingly, the plasma discharge can be achieved with a simple structure, so that the food residues can be decomposed and removed.

Third, in the case that the amount of ozone produced by the plasma discharger is more than the preset reference value, opening of the cooking chamber is prevented. Therefore, discharge of a large amount of ozone into the surrounding environment is prevented, so that the health of the user is not jeopardized by the ozone produced during the plasma discharge.

THE DETAILED DESCRIPTION

Hereinafter, exemplary embodiments of the present invention will be described with reference to accompanying drawings.

The plasma discharger of the present invention may be applied to any suitable type of cooking apparatus, such as a gas, electric or microwave oven. Further, the cooking apparatus of the present invention may include all kinds of devices capable of cooking food, such as a gas, electric or microwave oven.

Reference will now be made in detail to a cooking apparatus according to a first embodiment of the present invention, examples of which are illustrated in the accompanying drawings.

Figure 1:
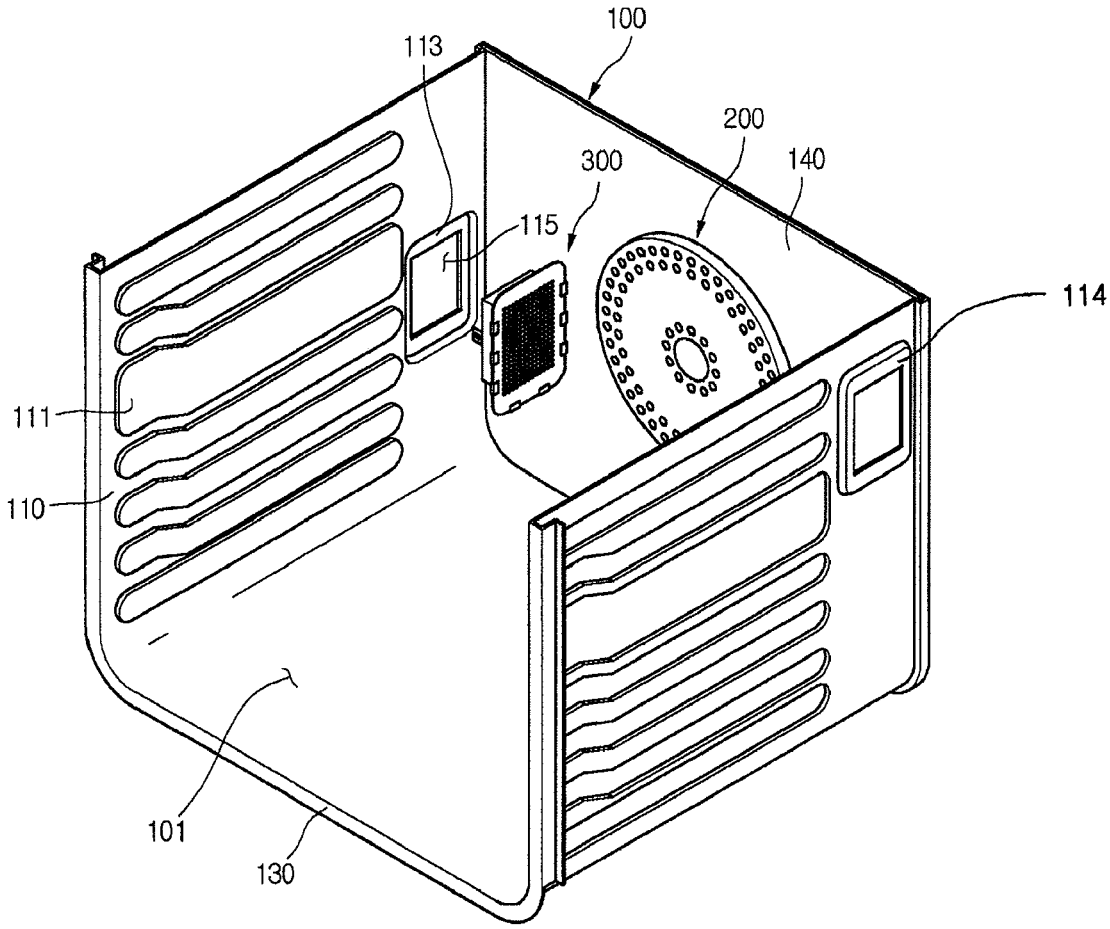
FIG. 1 is an exploded perspective view showing main parts of a cooking apparatus according to a first embodiment of the present invention.

FIG. 1 schematically shows an inner structure of a cooking apparatus according to a first embodiment of the present invention, in a perspective view.

Referring to FIG. 1, a cooking chamber 101 is provided in a case 100 of a cooking apparatus according to the first embodiment of the present invention. The cooking chamber 101 is a space where food is cooked. The case 100 includes a side plate 110 forming both side surfaces of the cooking chamber 101, a top plate (not shown) forming a ceiling of the cooking chamber 101, a bottom plate 130 forming a bottom surface of the cooking chamber 101 and a rear plate 140 forming a rear surface of the cooking chamber 101.

A plurality of support projections 111 are provided on the side plate 110. The support projection 111 is to support a rack or tray on which food is seated. A seat groove 113 is respectively formed in both side surfaces, i.e. the side plates 110, of the case 100. The seat groove 113 is an area where a plasma discharger 300 (described below) is installed. The seat groove 113 is depressed toward the outside of the case 100. According to the present embodiment, the seat grooves 113, 114 formed in both side surfaces of the case 100 may be formed at different heights. For example, it is possible that a seat groove 113 formed at a left side surface of the case 100 is formed at an approximate center of the side plate 110, and a seat groove 114 formed at a right side surface is formed at a location adjacent to an upper end of the side plate 110. This is to allow the decomposition of food residues to be accomplished within the cooking chamber 101 by the plasma discharger 300 seated on the seat groove 113 in an overall uniform manner. However, any suitable number of plasma dischargers may be provided at any suitable locations within the case 100.

A seat opening 115 is formed in the seat groove 113, respectively. The seat opening 115 is a portion, to which a casing 310 of a plasma discharger 300 is passed when the plasma discharger 300 is seated on the seat groove 113.

A convection device 200 is provided at the rear plate 140. The convection device 200 is to heat food in the cooking chamber 101. More specifically, the convection device 200 heats food in the cooking chamber 101 by convection, as it circulates hot air within the cooking chamber 101 by use of a fan. The convection device 200 includes a heating element such as a convection heater, and a convection fan which allows the heat generated from the heating element to be circulated in the cooking chamber 101. Any suitable type of blowing device, such as an axial flow fan, a cross flow fan and a centrifugal fan, can be provided as the convection fan. Though not depicted, another heating source may be provided to heat food in the cooking chamber 101. For example, an upper heater and a lower heater may be provided at the ceiling and the bottom surface of the cooking chamber 101, or an electrical part for oscillating microwave may be provided therein. Any suitable type of heating device may be provided.

Figure 2:
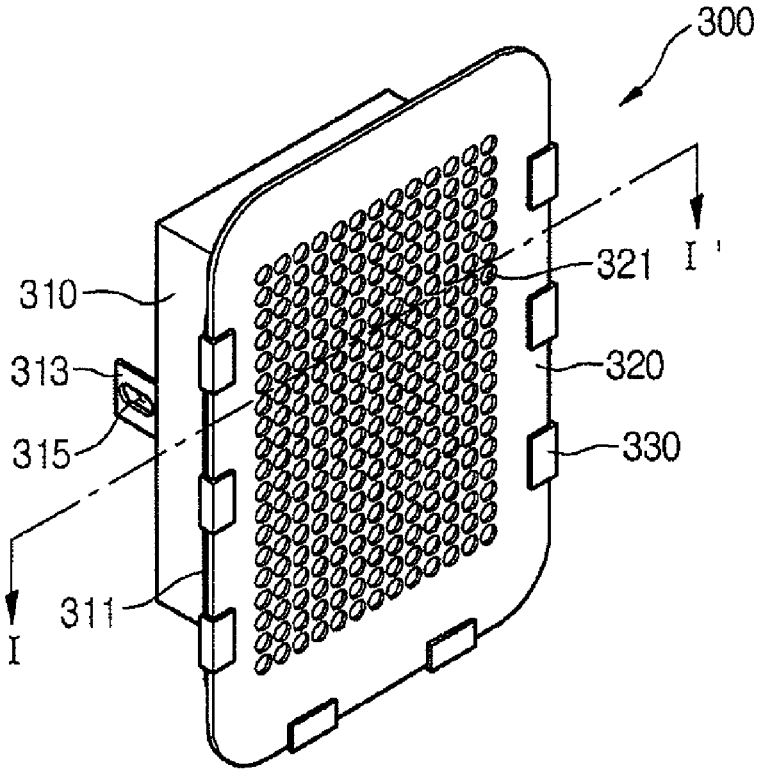
FIG. 2 is a perspective view showing a plasma discharger of the cooking apparatus of FIG. 1.
Figure 3:
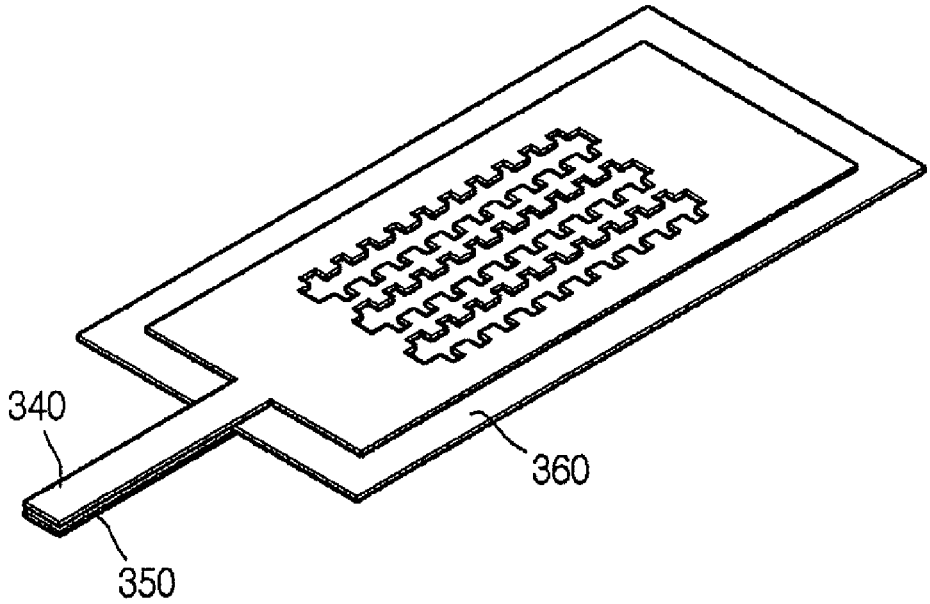
FIG. 3 is a perspective view showing a first electrode, a second electrode and a dielectric of the plasma discharger of FIG. 2.
Figure 4:
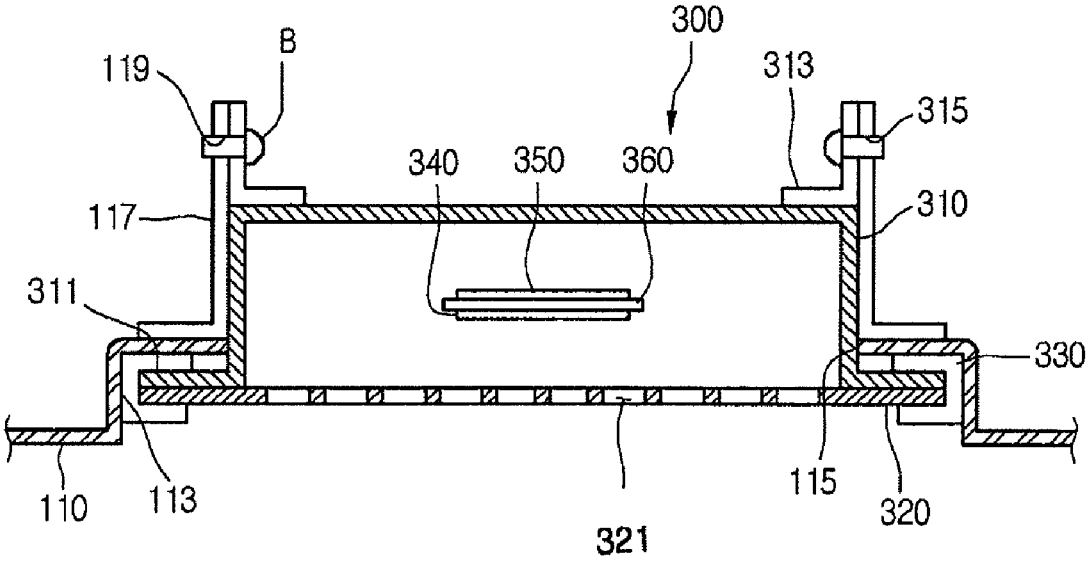
FIG. 4 is a horizontal cross-sectional view showing main parts of the plasma discharger of FIG. 2.

FIG. 2 is a perspective view of a plasma discharger according to the first embodiment of the present invention, FIG. 3 is a perspective view of a plasma discharge element provided in the plasma discharger, and FIG. 4 is a horizontal cross-sectional view taken along line I-I' in FIG. 2.

Referring to FIGS. 2 to 4, a plasma discharger 300 which is seated on the seat groove 113 will be described.

Specifically, when the plasma discharge is carried out by applying electric power to the plasma discharger 300, at least one of ozone ($O_3$), a negative ion such as a hydrated ion, and a $CH_3$—S radical group will be produced. Since the ozone, the hydrated ion and the $CH_3$—S radical group break off the C—H linkage of a principal component of the residues which are produced while cooking food, the residues of food are decomposed. Therefore, the removal of the residues of food and the removal of the smell of the residues are more easily accomplished.

More specifically, the plasma discharger 300 includes a casing 310, a cover 320, a plurality of fixing elements 330, and a plasma discharge element. The plasma discharge element includes a first electrode 340, a second electrode 350 and a dielectric 360. The casing 310 is passed through the seat opening 115 and is installed at the side plate 110. That is, the plasma discharger 300 may be removable or detachably provided at the wall surface of the case 100, as a module.

Meanwhile, an engaging flange 117 is provided at an outer side surface of the side plate 110 forming the seat groove 113. The engaging flange 117 is to fix both sides of the plasma discharger 300.

Specifically, the engaging flange 117 is bent in the shape of a letter "L", one surface thereof being fixed to a bottom surface of the seat groove 113, and the other surface of the engaging flange 117 being extended in a direction perpendicular to the side plate 110. An engaging hole 119 is formed at any suitable location of a region in which the other surface is extended in the direction perpendicular to the side plate 110. A fixing flange 313 is connected to one surface of the engaging flange 117, in particular to one side, of the surface extended in the direction perpendicular to the side plate 110. The fixing flange 313 is also bent in the shape of a letter "L," and the fixing flange is coupled to the engaging flange 117 by a suitable engaging element B, such as a bolt or screw. More specifically, the engaging element B passes through the engaging hole 119 of the engaging flange 117 and through an engaging hole 315 formed in one surface of the fixing flange 313, so that the engaging flange 117 and the fixing flange 313 are rigidly connected together. In such a state, the other surface of the fixing flange 313 supports the plasma discharger 300, in particular the bottom surface of the casing 310.

Also, a support flange 311 is formed at an opened surface of the casing 310. The support flange 311 is outwardly bent at an edge of the opened surface of the casing 310, and is extended outward. The flange 311 serves to support the cover 320.

The cover 320 serves to close the opened, front surface of the casing 310. Specifically, a bottom edge of the cover 320 is tightly connected to the front surface of the flange 311 and is supported thereon. A plurality of through holes 321 are formed in the cover 320, so that ozone gas produced by the plasma discharge is transferred to the outside of the casing 310, to the inside of the cooking chamber 101 via the through holes 321.

The fixing element 330 serves to fasten the casing 310 and the cover 320. Specifically, the fixing element 330 is bent in the shape of a "[", so that it surrounds edge portions of the flange 311 and the cover 320.

An outer circumferential surface of the casing cover 320 is level with an inner surface of the case 100, when the plasma discharger 300 is seated on the seat groove 113. However, the casing cover 320 may be recessed relative to the inner surface of the case 100 in accordance with the depth of the seat groove 113. Since the plasma discharger 300 does not protrude from the inner surface of the case 100, the plasma discharger is prevented from interfering with the food or tray in the cooking chamber 101.

Meanwhile, the first electrode 340, second electrode 350 and dielectric 360 constituting the plasma discharge element are where the plasma discharge is substantially performed. Specifically, the first and second electrodes 340, 350 are installed to be spaced apart from each other with respect to the dielectric 360. And, when high voltage is applied to the first electrode 340, electrons are accelerated in an electric field area between the first electrode 340 and the second electrode 350 which is substantially grounded. Ambient air is ionized by the accelerated electrons, thereby producing ozone as described above.

Hereinafter, an operation of the cooking apparatus according to the first embodiment of the present invention will be explained in detail.

First, when the cooking apparatus is operated by users, a heating source, for example the convection device 200 will be operated. Therefore, the air circulated in the cooking chamber 101 is heated by the convection device 200, and, food in the cooking chamber 101 is heated and cooked by the heated hot air.

Meanwhile, residues of food, such as oiliness, may be produced while cooking the food in the cooking chamber 101. The residues of food are apt to stick to a wall surface of the cooking chamber 101. The residues of food adhered to the wall surface of the cooking chamber 101 contaminate the cooking chamber 101 and generate odor.

When the plasma discharger 300 is operated by the user, the residues of food adhered to the wall surface of the cooking chamber 101 will be decomposed by the plasma discharge. More specifically, when electric power is applied to the first electrode 340, the plasma discharge is generated by ionizing ambient air, as electrons are accelerated in the electric field area between the first electrode 340 and the second electrode 350. The residues of food adhered to the wall surface of the cooking chamber 101 is decomposed by ozone, a hydrated ion and a $CH_3$—S radical group which are produced by the plasma discharge. When these residues are decomposed, the user can use the clean cooking apparatus by easily removing them.

Hereinafter, the cooking apparatus according to the second embodiment of the present invention will be explained in detail with reference to the accompanying drawings.

Figure 5:
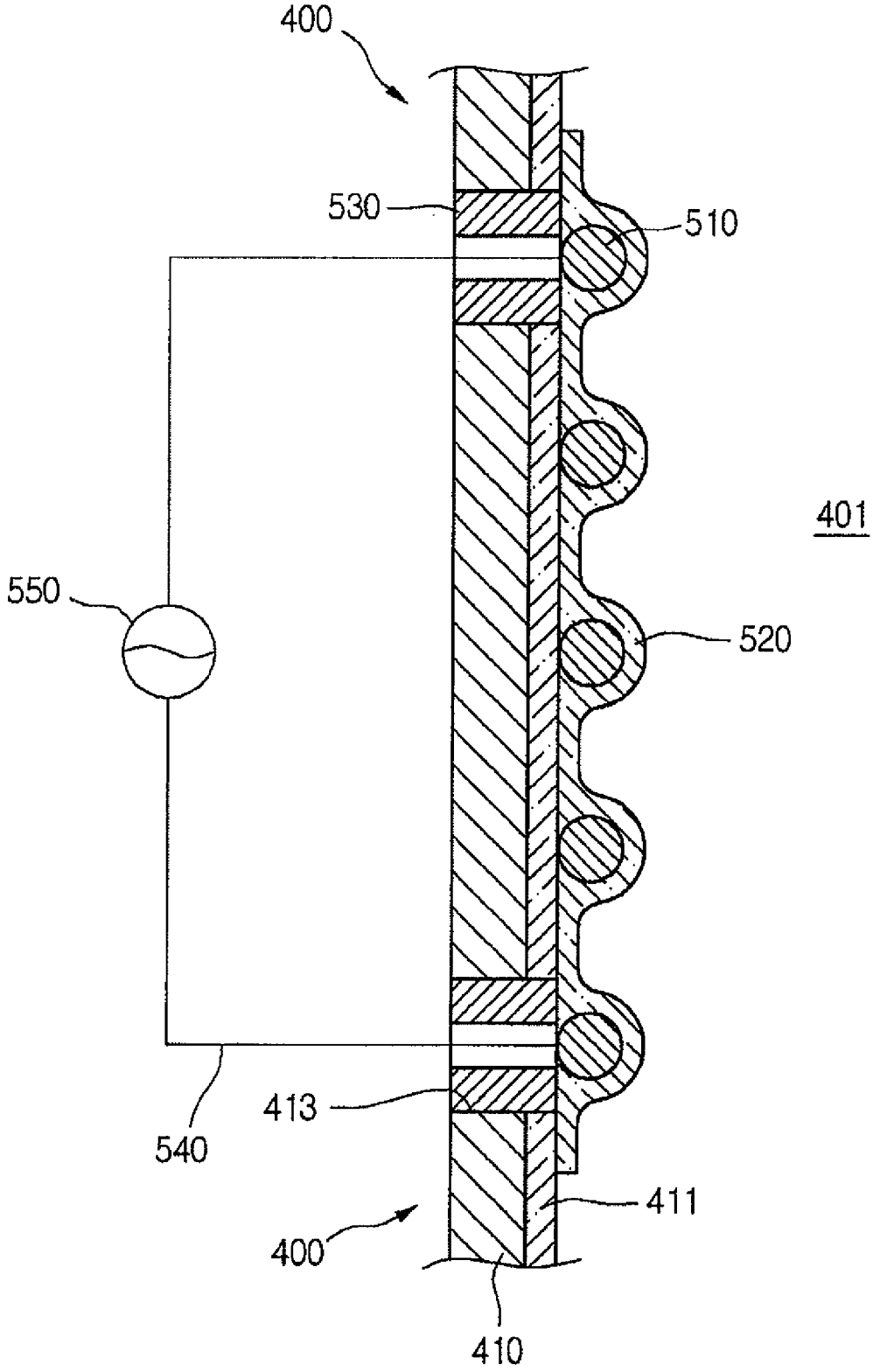
FIG. 5 is a longitudinal cross-sectional view showing main parts of a cooking apparatus according to a second embodiment of the present invention.

FIG. 5 shows a wall surface structure of the cooking apparatus according to the second embodiment of the present invention in a longitudinal cross-sectional view. In addition to the configuration of the plasma discharger discussed with regard to FIG. 5, the other structures of the second embodiment may be similar to that discussed with regard to the first embodiment.

Referring to FIG. 5, a cooking chamber 401 is provided in a case 400 according to the second embodiment of the present invention. A side plate 410 constituting a side surface of the case 400 forms a side surface of the cooking chamber 401.

An enamel coating layer 411 is provided at one surface of the side plate 410 facing toward the cooking chamber 401. The enamel coating layer 411 is to protect the side plate 410 from contamination or scratch caused by external impact. This enamel coating layer 411 may be formed by coating glass material capable of serving as a dielectric to one surface of the side plate 410.

Also, two through holes 413 are formed in the side plate 410. The through hole 413 may be formed by cutting through a portion of the side plate 410. A guide bush 530 is installed in the through hole 413.

An electrode 510 is mounted on a surface, exposed to the cooking chamber 401, of the side plate. According to the embodiment, a conductor wire, bent a plurality of times, may be used as the electrode 510, however any suitable type of electrode may be provided.

An insulation coating layer 520 may be provided at an outer circumferential surface of the electrode 510. Specifically, the purpose of the insulation coating layer 520 is to protect the electrode 510. As the insulation coating layer 520 any suitable material, such as silicon dioxide ($SiO_2$), may be used.

The guide bush 530, through which a power line 540 is passed, is installed in the through hole 413, respectively. The guide bush 530 serves to protect the power line 540.

The power line 540 is respectively connected to both ends of the electrode 510. The power line 540 is to connect an external power source 550 with the electrode 510. The power line 540 is connected to the electrode 510 by passing through the guide bush 530.

According to the present embodiment, when voltage from an external power source, such as commercial voltage supplied to a house, is applied to the electrode 510, the case 400 acts as the other electrode and the enamel coating layer 411 acts as the dielectric. Accordingly, the plasma discharge is carried out by ionizing ambient air, as electrons are accelerated in the electric field area between the electrode 510 and the side plate 410.

Hereinafter, the cooking apparatus according to the third embodiment of the present invention will be explained in detail with reference to the accompanying drawings.

Figure 6:
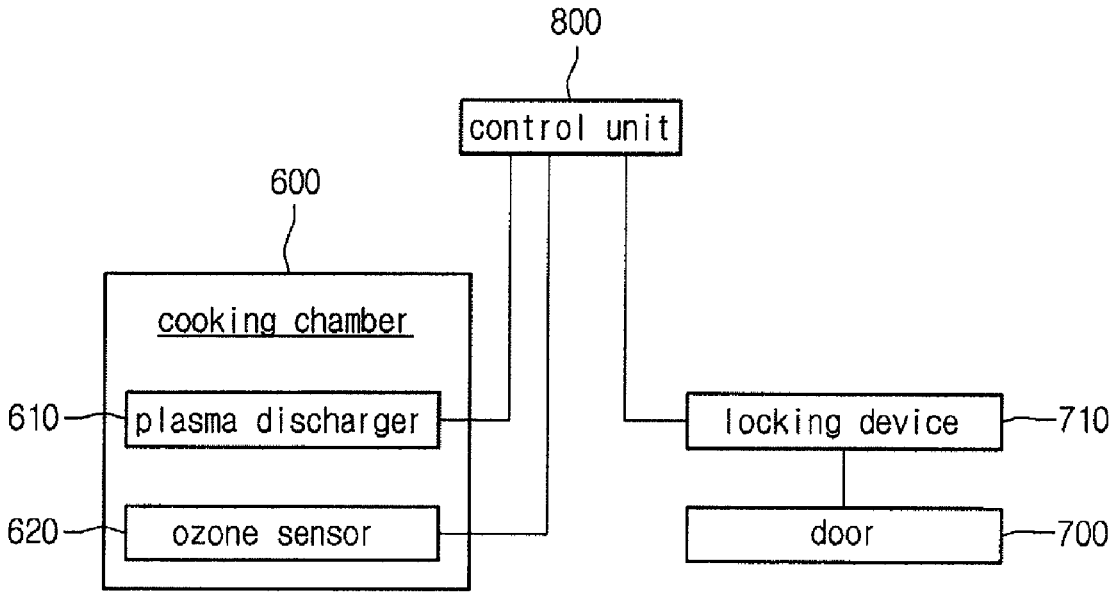
FIG. 6 is a system block diagram showing a cooking apparatus according to a third embodiment of the present invention.

FIG. 6 shows a structure of the cooking apparatus according to the third embodiment of the present invention in a block diagram. Though ozone may be used to effectively remove residue and odor-producing materials from the cooking chamber, there is a danger that ozone may be harmful to human health when it is discharged to the outside. Accordingly, it is necessary to limit the amount of ozone discharged to a set value or less. The third embodiment of the present invention prevents the discharge of too much ozone to the outside. Further, it is noted that the ozone discharge prevention system of the third embodiment may be provided in cooking apparatus such as those of the first and second embodiments described above.

Referring to FIG. 6, a plasma discharger 610 and an ozone sensor 620 may be provided in a cooking chamber 600 of the cooking apparatus according to the third embodiment of the present invention. Any suitable plasma discharger 610, such as those described above with regard to the first and second embodiments of the present invention, may be provided. The ozone sensor 620 serves to detect the amount of ozone produced by the operation of the plasma discharger 610, by detecting the ozone concentration in the cooking chamber 600.

A locking device 710 for limiting the opening and shutting of a door 700, which selectively opens/closes the cooking chamber 600, may be provided in the cooking apparatus. A control unit 800 of the cooking apparatus serves to restrict the opening of the door 700 according to the ozone concentration, detected by the ozone sensor 620, in the cooking chamber 600. In other words, the control unit 800 controls to prevent the opening of the door 700 when the ozone concentration, detected by the ozone sensor 620, in the cooking chamber 600 exceeds a predetermined concentration value. The reference value may be any suitable level of ozone concentration, such as a level of ozone concentration which might be harmful to humans.

Specifically, since ozone produced during the plasma discharge of the plasma discharger 610 may be harmful to humans, according to the present embodiment, the door 700 may be prevented from opening when the ozone concentration in the cooking chamber 600 exceeds the predetermined value. Therefore, it is possible to prevent the user's health from being damaged by the ozone.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

While the invention has been shown and described with reference to certain exemplary embodiments thereof, it will be understood by those skilled in the art that various changes in form and details may be made therein without departing from the spirit and scope of the invention as defined by the appended claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A cooking apparatus comprising:

a case whose interior defines a cooking chamber for cooking food; a door configured to selectively open or close the cooking chamber;

a plasma discharger connected to the case and configured to generate plasma to produce a gas, that cleans residues from the cooking chamber the plasma discharger including a first electrode which is applied with a voltage, a second electrode which is grounded, and a dielectric provided between the first and second electrodes, wherein the second electrode comprises the case; a sensor configured to detect the concentration of the gas produced during plasma discharge generation by the plasma discharger; a locking device configured to restrict opening of the door according to the gas concentration detected by the sensor; and a convection device provided in the case and configured to heat and circulate air, including the gas generated by the plasma discharger, in the cooking chamber in order to remove food residue on a surface of the case, wherein the first electrode and the dielectric do not protrude into the cooking chamber.

2. The cooking apparatus according to claim 1, wherein the first electrode includes a wire arranged to have plural bends.

3. The cooking apparatus according to claim 1, wherein the dielectric includes an enamel coating layer provided on an inner surface of the case.

4. The cooking apparatus according to claim 1, further comprising:

an insulation layer surrounding the first electrode.

5. The cooking apparatus according to claim 4, wherein the insulation layer is a coating layer of $SiO_2$ material.

6. The cooking apparatus according to claim 1, wherein the first electrode is connected to an external power line passing through a side surface of the case.

7. The cooking apparatus according to claim 1, wherein the convection device includes a heater that generates heat and a fan that circulates air inside of the case.

* * * * *